United States Patent [19]

Comfort

[11] Patent Number: 4,722,038

[45] **Date of Patent: * Jan. 26, 1988**

[54] EASILY LOCATABLE NIGHT LIGHT/HOLDER

[76] Inventor: Richard A. Comfort, 6444 Aldea Ave., Van Nuys, Calif. 91406

[ * ] Notice: The portion of the term of this patent subsequent to Apr. 22, 2003 has been disclaimed.

[21] Appl. No.: 815,527

[22] Filed: Jan. 2, 1986

Related U.S. Application Data

[63] Continuation-in-part of Ser. No. 652,100, Sep. 19, 1984, Pat. No. 4,584,633.

[51] Int. Cl.[4] ..... F21V 33/00

[52] U.S. Cl. ..... 362/253; 200/85 R; 362/394; 362/801; 362/109

[58] Field of Search ..... 362/253, 394, 801, 235, 362/234, 109, 116, 132, 29, 130; 200/85 R

[56] References Cited

U.S. PATENT DOCUMENTS

| | | | |
|---|---|---|---|
| 2,273,353 | 2/1942 | Harris | 362/253 |
| 2,617,910 | 11/1952 | Ilarraza y Segora | 362/235 |
| 2,998,508 | 8/1961 | Bobrick | 362/801 |
| 3,017,497 | 1/1962 | Albright | 362/394 |
| 4,285,028 | 8/1981 | Sundin | 362/253 |
| 4,584,633 | 4/1986 | Comfort | 362/253 |

*Primary Examiner*—Carl Stuart Miller

*Attorney, Agent, or Firm*—Andra M. Finkel

[57] ABSTRACT

The present invention comprises holder to be used by the blind or other visually impaired persons to locate items on a night table. The holder comprises a power inlet to the device, and a power outlet such as an AC socket into which may be plugged a reading lamp, bedside radio, etc. The device of the invention further comprises an internal appliance such as a small lamp or radio which is mounted so as to facilitate the location and retrieval of an item placed in the holder in the dark. A normally closed switch is located between the power inlet and the power outlet so that the AC current from the inlet is normally available at the power outlet for lighting a reading lamp or the like. When an item is placed in the holder, the device plugged into the outlet is turned off. Also, when the item is placed in the holder, the switch closes in response thereto to supply power to the internal appliance which stays on as the item remains in the holder to facilitate retrieval of it in a dark room. When the item is removed from the holder, the small appliance shuts off and the normally closed switches return to their equilibrium states.

23 Claims, 4 Drawing Figures

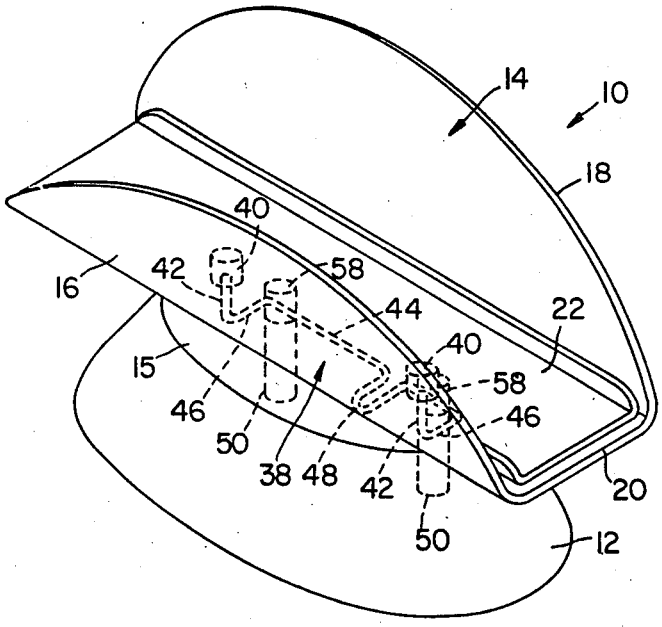
FIG.1
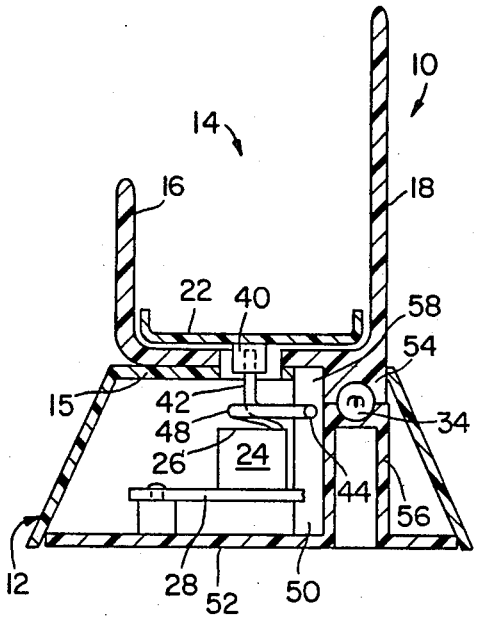
FIG.3
FIG.4
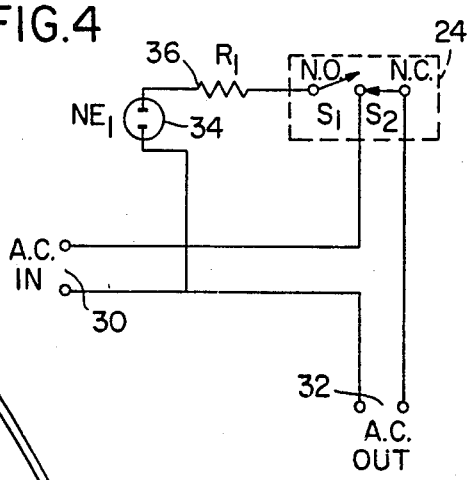
FIG.2
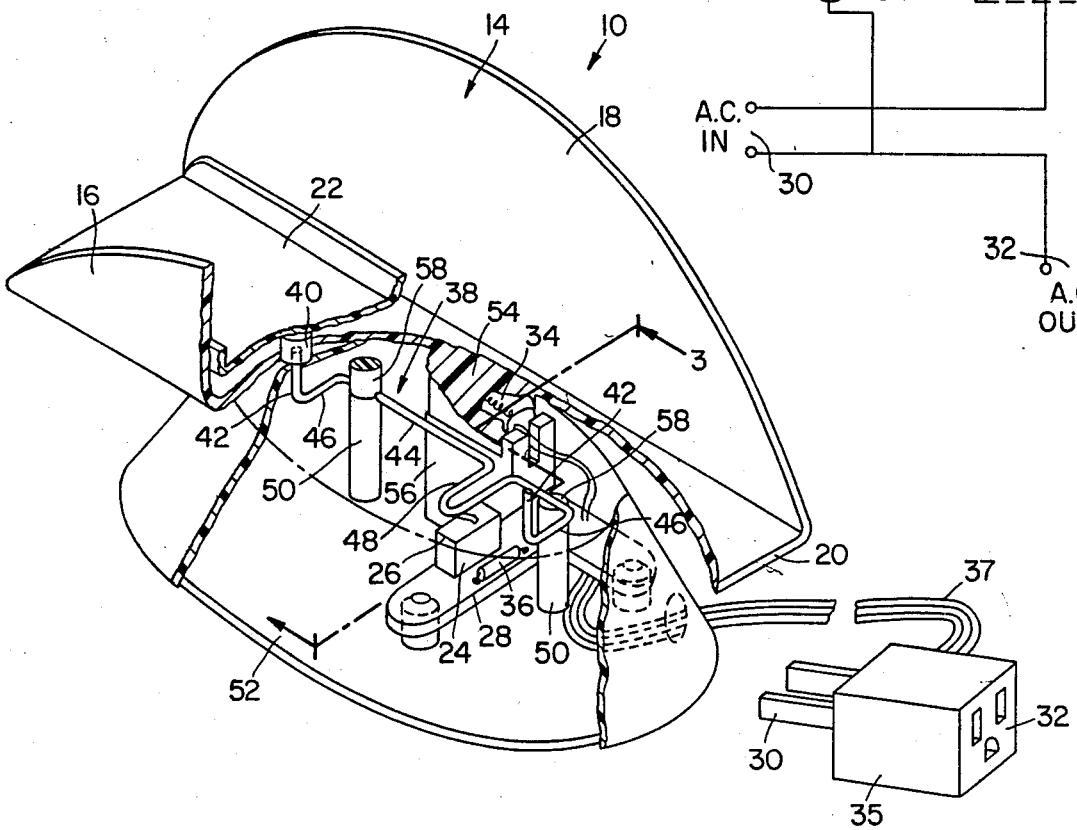

EASILY LOCATABLE NIGHT LIGHT/HOLDER

BACKGROUND OF THE INVENTION

This is a continuation-in-part of Ser. No. 06/652,100, filed Sept. 19, 1984, now U.S. Pat. No. 4,584,633, entitled "Combination Night Light Eyeglass Holder."

FIELD OF THE INVENTION

The present invention pertains generally to a device for the blind or persons with vision problems. More particularly, the invention relates to a holder provided with an internal appliance and switch means for cutting off power to an external appliance while switching on the internal appliance when something is placed in the holder.

More specifically, the device pertains to the field of night lights and holders for bedside use.

BACKGROUND OF THE INVENTION

Various devices are known comprising a switch responsive to the presence of goggles for controlling power to some device. In particular, in U.S. Pat. Nos. 2,466,355 to Baker and 2,800,543 to Herzog, electrical power to a motor driven tool is controlled by a switch which responds to the weight of a pair of safety goggles which are hung therefrom. The removal of the goggles automatically activates a switch to the operative position and replacement of the goggles to their initial position activates the switch to the inoperative position; it being impossible to activate the switch to either position manually without the goggles.

Other prior art devices disclose pressure operated switches which control power to a bedroom light, as exemplified by U.S. Pat. Nos. 2,185,051 to Daigle and 2,425,790 to Fletcher. These two patents disclose light switches which respond to the weight of a person occupying a bed and control power to a bedroom light in response thereto.

None of these prior art devices overcome the problem of controlling an appliance light in response to a person's removing and placing an item such as eyeglasses, false teeth, etc., on a nightstand in preparation for retiring for the night, while also providing means for assisting the person in subsequently retrieving the item in a darkened room and/or acting as a night light.

SUMMARY OF THE INVENTION

The present invention relates to a device for blind or persons with vision problems and comprises a holder which operates an external and an internal appliance.

Specifically, in the preferred embodiment of the invention, the device comprises a holder which may have a suitable ornamental appearance, a power inlet to the device, a power outlet such as an AC socket into which may be plugged an external appliance such as a reading lamp, bedside radio, etc. The device of the invention further comprises a small appliance such as a light, radio or the like which is mounted in or next to the device so as to facilitate location and retrieval of the item placed in the holder.

A first switch is connected between the power inlet and the power outlet. When the first switch is opened, the AC current from the inlet is available at the outlet to operate a small external appliance. For example, if a pair of eyeglasses is placed in the holder, the first switch will open, interrupting the power to the outlet, thereby extinguishing the lamp or other small appliance plugged into the outlet. A second switch is connected between the internal appliance and the power inlet. The second switch closes in response to the placement of the item in the holder. For example, when the device is used as a night light/eyeglasses holder, placement of the eyeglasses in the holder will supply power to the lamp which remains lit so long as the item remains in the holder, to facilitate retrieval of the eyeglasses in the room.

When the item is removed from the holder, both the first and second switches return to their equilibrium states, such that power is supplied to the external appliance plugged into the power outlet, and the internal appliance is extinguished.

In the preferred embodiment of the invention, the switches are actuated in response to the weight of the item on a moveable support provided in the bottom of the holder. Further, the first and second switches may be combined in a single device such as a single pole, double throw microswitch disposed underneath the holder and mechanically connected to the moveable support such that the switch is actuated upon depression of the support by the weight of item.

In an alternate embodiment of the invention, mounted on the moveable support is a domed geometrically shaped translucent structure in place of the holder on the preferred embodiment. By pressing on the dome, the first switch will open, extinguishing power to the external appliance connected thereto and the second switch will close to supply power to a light underneath the dome such that the device operates as a night light.

BRIEF DESCRIPTION OF THE DRAWINGS

FIG. 1 is a perspective view of the device of the present invention with the switch actuating rod shown in phantom lining.

FIG. 2 is a perspective view of the device of FIG. 1 partly broken away to illustrate the internal switch arrangement.

FIG. 3 is a cross-section taken in elevation along lines 3—3 in FIG. 2.

FIG. 4 is an electrical schematic diagram of the device of FIG. 1.

DETAILED DESCRIPTION OF THE PREFERRED EMBODIMENT

Referring first to FIGS. 1, 2 and 3, the device 10 of the present invention comprises a base 12 to which is mounted holder 14. In the preferred embodiment, the holder 14 is constructed such that it has a front wall 16, a rear wall 18, and a bottom 20, defining a generally U-shaped channel. However, any shape can be used depending on the item to be placed in the holder. An elongated rectangular switch bar 22 is disposed along the bottom of the holder 14. Bar 22 is supported by a pair of posts 40 extending downwardly into the interior of the base 12 through aligned openings in the holder bottom 20 and base 12. While the holder bottom 20 is affixed by any suitable means to the base 12, the switch bar 22 and first supporting posts 40 are vertically movable relative to both the base 12 and the holder 14.

A single pole, double-throw microswitch 24 provided with an actuating lever 26 is mounted to the base 12 by means of a circuit board 28. Any commercially available switch may be used as switch 24, such as, by way of example and not limitation, a subminiature SPDT lever switch with the contacts rated at 5 amps at 250 VAC. However, in lieu of a single microswitch, two separate switches may be used such that the first switch is normally open and the second switch is normally closed.

With reference to FIG. 4, the normally closed side (S2) of switch 24 is connected between an AC inlet 30 and an AC outlet 32. The AC outlet 32 is normally connected to an external appliance (not shown) such as a reading lamp, radio, TV, etc. While a separate male plug and a female socket may be used for the inlet 30 and outlet 32, respectively, each connected by its own two conductor AC cord to the switch 24, it is preferable to use a combination plug 35 such as illustrated in FIG. 2, having male prongs on one side for the AC inlet 30, and female socket terminals on another side for the AC outlet 32. The combination plug is connected to the switch 24 by a three conductor cord 37 (omitted in FIG. 1 for clarity), wherein one of the conductors is common both to the AC inlet 30 and AC outlet 32.

Referring to FIG. 4, an internal appliance 34 is connected through a series current limiting resistor 36 and the normally open side (S1) of switch 24 to the power inlet 30. In its equilibrium state power from the AC inlet 30 is supplied through the normally closed side (S2) of switch 24 to the power outlet 32, and the power to the internal appliance 34 is interrupted by the normally open side (S1) of switch 24.

A switching rod 38 has a pair of upwardly extending ends 42 fitted into the supporting posts 40 of the switch bar 22, and has a horizontally extending portion 44 connecting the two vertical ends 42 of the switching rod, but laterally offset by parallel horizontal portions 46. The horizontally extending portion 44 further has a hairpin turn 48 overlying the lever 26 of the switch 24. The horizontal portion 44 is held captive but free for pivotal movement between a second pair of posts 50 rising from the bottom 52 of the base 12 into a third pair of posts 58 extending downwardly from the top 15 of the base 12. A groove is formed in the upper end of each second post 50 and in the lower ends of third posts 58. The base housing 12 may have a separate bottom 52 to which are affixed the two second posts 50. When the bottom 52 is secured to the base housing 12, by way of example and not limitation, a snap fit, gluing, screwing or other means, the upper ends of the second posts 50 abut the lower ends of the posts 58 such that the grooves in the second and third posts ends 50 and 58, respectively, oppose each other and together define bores within which the switching rod 39 pivots such that when a weight is placed on the switch bar 22, a downward force is applied through first posts 40 to the ends of arms 46 of the switching rod 38. The force offsets the switching rod 38 such that the horizontal portion 44 pivots bringing the hairpin portion 48 downward against the actuating lever 26 of the switch 24, throwing the switch 24 so that the normally open section (S1) of the switch 24 closes while the normally closed section (S2) opens. The internal appliance circuit is thus closed, supplying power to the internal appliance 34 while interrupting power to an external appliance (not shown) connected to the AC outlet 32.

In the preferred embodiment, the base 12 is molded of an opaque plastic material, while the holder 14 and switch bar 22 are made of translucent plastic. The base 12 has a light guide portion 54 extending through an opening in the top of the base 12, and having a concave cylindrical surface 55 adapted to fit against the outer surface of the small internal appliance such as a lamp 34 within the base 12. The lamp 34 is horizontally supported by a support 56 which extends upwardly from the base bottom 52. When the device 10 is assembled, the lamp is held captive between the support 56 and the light guide 54. The lamp 34 is connected to the switch 24 through conductors provided on the circuit board 28. When assembled, the light guide portion 54 of the holder 14 fits against the neon lamp 34 and serves as an optical wave guide whereby light emitted by the neon lamp is guided and diffused throughout the holder 14, creating a low level diffused glow sufficient for locating the eyeglass holder in the dark, but dim enough so as not to disturb sleep.

In the preferred embodiment, the base 12 is elliptical in plan view and frustoconical in elevation. However, both the base 12 and the holder 14 may take shapes other than those shown. It will be further understood that the invention extends to means for sensing the presence of an item in the holder 14 activated by other than the weight of the item such as, for example, photosensing means activated by light changes on a sensing element caused by placement of the item thereon.

In an alternate embodiment of the present invention, a geometrically shaped structure of transparent or translucent material is placed on top of moveable support arms 46 of support 56 in lieu of holder 14. When downward pressure is applied to structure normally the open side of switch 24 closes and the normally closed side of switch 24 opens causing the light coupled to the normally open side to illuminate. By applying a downward pressure again to structure, the reverse process occurs whereby the light is turned off.

Obviously, while the invention has been described, with reference to the specific preferred embodiment thereof, it will be understood by those skilled in the art that simple substitutions, changes and other modifications in form and detail may be made therein without departing from the spirit and scope of the invention by those possessed by ordinary skill in the art.

What is claimed is:

1. A holder for use by a blind or partially blind individual in order to locate an item placed in the holder, comprising:

holder means for holding the item;

power inlet and power outlet means;

locating means for identifying the location of the item;

first switch means connecting said power inlet to said power outlet, said first switch means opening in response to the placement of the item in said holder means to cut off power to said outlet;

second switch means connected between said locating means and said power inlet means, said second switch means closing in response to the placement of the item in said holder means to supply power to an internal appliance thereby to facilitate retrieval of the item;

said first and second switch means returning to their equilibrium states upon removal of the item from said holder means.

2. The holder of claim 1 wherein said first and second switch means are responsive to the weight of the item placed in said holder means.

3. The holder of claim 1 wherein said first and second switch means are coupled together to comprise a single pole double throw pressure sensitive switch means.

4. The holder of claim 3 further comprising support means within said holder means, said support means bearing on said pressure sensitive switch means for transmitting the weight of the item placed in said holder means against said switch means thereby to throw said sensitive switch means from its equilibrium state.

5. The holder of claim 4 further comprising base means for supporting said holder means, said sensitive switch means being mounted within said base means, said support means bearing on a pivotable switch rod within said base means, said switch rod acting against said switch means in response to a downward force applied to said support means for throwing said sensitive switch means from said equilibrium state.

6. The holder of claim 1 wherein said locating means comprises a night light.

7. The eyeglass holder of claim 6 wherein said holder means is made of a material translucent to light, said holder means being illuminated by said night light to thereby facilitate retrieval of the item placed in said holder means.

8. The holder of claim 6 wherein said night light is a neon lamp.

9. The holder of claim 7 wherein said holder means includes light guide means in contact with said night light to thereby diffuse the light emitted by said night light through said translucent holder means to create a diffused glow.

10. The holder of claim 1 wherein said holder means is a channel structure including a front wall, a rear wall and bottom connecting said front and rear walls.

11. The holder of claim 2 wherein said holder means is a channel structure including a front wall, a rear wall and a bottom connecting said front and rear walls, said support means including an elongated rectangular support member disposed above the bottom of said holder means, said support member comprising post means extendng through said holder means into said base means, and switch actuating means connected to said post means and bearing against said first and second switch means responsive to placement of an item within said holder means and on said support means to thereby throw said first and second switch means.

12. The holder of claim 1 further comprising sensing means for sensing the presence of the item in the holder wherein when the item is present, said first and second switch means are opened and closed, respectively.

13. The holder of claim 1 wherein the power outlet means is connected to an external appliance whereby when the first switch means is closed, power is supplied to the external appliance.

14. A night lamp comprising:

a geometrical structure holder means;

power inlet and power outlet means;

night light means;

first switch means connecting said power inlet to said power outlet, said first switch means opening in response to an external pressure placed on said geometrical structure to cut off power to said outlet;

second switch means connected between said night light and said power inlet means, said second switch means closing when an external pressure is placed on said geometrical structure holder means to supply power to said night light means;

said first and second switch means returning to their equilibrium states upon a release of said external pressure to said geometrical structure holder means.

15. The night lamp of claim 14 wherein said first and second switch means are responsive to the pressure of a human hand placed on said geometrical structure.

16. The night lamp of claim 14 wherein said first switch means and second switch means are a single pole double throw pressure sensitive switch.

17. The night lamp of claim 16 further comprising support means within said holder means, said support means bearing on said pressure sensitive switch means for transmitting the pressure placed on said geometrical structure against said switch means thereby to throw said switch means from its equilibrium state.

18. The night lamp of claim 16 further comprising base means said switch means being mounted within said base means, said support means bearing on a pivotable switch rod within said base means, said switch rod acting against said switch means in response to a downward force applied to said support means for throwing said switch means from said equilibrium state.

19. The night lamp of claim 14 wherein said night light means comprises one or more neon or other inert gas lights.

20. The night lamp of claim 14 wherein said holder means is made of a material translucent to light, said holder means being illuminated by said night light.

21. The night lamp of claim 20 wherein said night light is a neon lamp.

22. The night lamp of claim 20 wherein said holder means includes light guide means in contact with said night lamp to thereby diffuse the light emitted by said night light through said translucent holder means to create a diffused glow.

23. The night lamp of claim 14 wherein the power outlet means is connected to an external appliance whereby when the first switch means is closed, power is supplied to the external appliance.

* * * * *